US008523531B2

(12) United States Patent
Micheli et al.

(10) Patent No.: US 8,523,531 B2
(45) Date of Patent: Sep. 3, 2013

(54) AIRFOIL FOR A COMPRESSOR BLADE

(75) Inventors: Marco Micheli, Schoefflisdorf (CH); Luis Frederico Puerta, Rieden (CH); Wolfgang Kappis, Fislisbach (CH)

(73) Assignee: ALSTOM Technology Ltd, Baden (CH)

( * ) Notice: Subject to any disclaimer, the term of this patent is extended or adjusted under 35 U.S.C. 154(b) by 923 days.

(21) Appl. No.: 12/646,627

(22) Filed: Dec. 23, 2009

(65) Prior Publication Data

US 2011/0150659 A1 Jun. 23, 2011

(51) Int. Cl.
*F01D 5/14* (2006.01)

(52) U.S. Cl.
USPC ..... 416/243; 416/223 A; 416/DIG. 2

(58) Field of Classification Search
USPC ..... 416/243, 223 A, DIG. 2, DIG. 5
See application file for complete search history.

(56) References Cited

U.S. PATENT DOCUMENTS

| | | | |
|---|---|---|---|
| 5,286,168 | A | 2/1994 | Smith |
| 5,352,092 | A | 10/1994 | Ferleger et al. |
| 5,980,209 | A | 11/1999 | Barry et al. |
| 6,331,100 | B1 | 12/2001 | Liu et al. |
| 6,398,489 | B1 | 6/2002 | Burdgick et al. |

FOREIGN PATENT DOCUMENTS

| | | | |
|---|---|---|---|
| EP | 0 887 513 | A2 | 12/1998 |
| EP | 1 106 836 | A2 | 6/2001 |

OTHER PUBLICATIONS

European Search Report dated Sep. 14, 2009.

*Primary Examiner* — Edward Look
*Assistant Examiner* — Jesse Prager
(74) *Attorney, Agent, or Firm* — Buchanan Ingersoll & Rooney PC

(57) ABSTRACT

An improved second stage airfoil for a compressor blade having a unique chord length (CD), a stagger angle (γ), and camber angle (Δβ). The stagger angle (γ) and camber angle (Δβ) provide improved aerodynamics while the chord length (CD) provides for reduced airfoil weight.

5 Claims, 5 Drawing Sheets

AIRFOIL FOR A COMPRESSOR BLADE

FIELD

The present disclosure relates generally to gas turbine compressor airfoils and more particularly to airfoil profiles for second stage compressor blades.

BACKGROUND INFORMATION

There are many design requirements for each stage of a gas turbine compressor in order for the stages to meet design goals including overall efficiency, airfoil loading and mechanical integrity. Of particular concern are the design of the second stage blade of a compressor, since it is an entry blade into the compressor.

Many airfoil profiles for gas turbines have been provided. See, for example EP0 887 513 B1, which discloses the stagger angle and camber angle of an airfoil of a first stage turbine blade. Compressor design is, however, at a constant state of flux due to a desire to improve efficiency. There is therefore an advantage in providing airfoil designs that improve the balance of mechanical integrity and aerodynamic efficiency in these newly developed turbines. There is therefore a desire to achieve airfoil designs to facilitate this development.

SUMMARY

An exemplary embodiment provides airfoil for a second stage compressor blade. The exemplary airfoil comprises a plurality of chord lengths, a plurality of stagger angles, and a plurality of camber angles at a plurality of divisions, respectively, along an airfoil height starting from a reference point at a first end of the airfoil extending to a second distal end. At a first division starting from the reference point, the airfoil height is 0.000 mm, the stagger angle is 27.282 degrees, the chord length is 168.800 mm, and the camber angle is 28.038 degrees. At a second division between the first division and the second distal end of the airfoil, the airfoil height is 63.053, the stagger angle is 33.687 degrees, the chord length is 168.600 mm, and the camber angle is 24.400 degrees. At a third division between the second division and the second distal end of the airfoil, the airfoil height is 123.015 mm, the stagger angle is 39.234 degrees, the chord length is 169.600 mm, and the camber angle is 21.195 degrees. At a fourth division between the third division and the second distal end of the airfoil, the airfoil height is 180.479 mm, the stagger angle is 44.049 degrees, the chord length is 171.400 mm, and the camber angle is 18.324 degrees. At a fifth division between the fourth division and the second distal end of the airfoil, the airfoil height is 235.744 mm, the stagger angle is 48.213 degrees, the chord length is 173.500 mm, and the camber angle is 15.840 degrees. At a sixth division between the fifth division and the second distal end of the airfoil, the airfoil height is 289.030 mm, the stagger angle is 51.793 degrees, the chord length is 175.500 mm, and the camber angle is 13.693 degrees. At a seventh division between the sixth division and the second distal end of the airfoil, the airfoil height is 340.550 mm, the stagger angle is 54.848 degrees, the chord length is 177.100 mm, and the camber angle is 11.851 degrees. At an eighth division between the seventh division and the second distal end of the airfoil, the airfoil height is 390.500 mm, the stagger angle is 57.428 degrees, the chord length is 178.100 mm, and the camber angle is 10.289 degrees. At a ninth division between the eighth division and the second distal end of the airfoil, the airfoil height is 439.080 mm, the stagger angle is 59.577 degrees, the chord length is 178.000 mm, and the camber angle is 8.976 degrees.

BRIEF DESCRIPTION OF THE DRAWINGS

Additional refinements, advantages and features of the present disclosure are described in more detail below with reference to exemplary embodiments illustrated in the drawings, in which.

DETAILED DESCRIPTION

Figure 1:
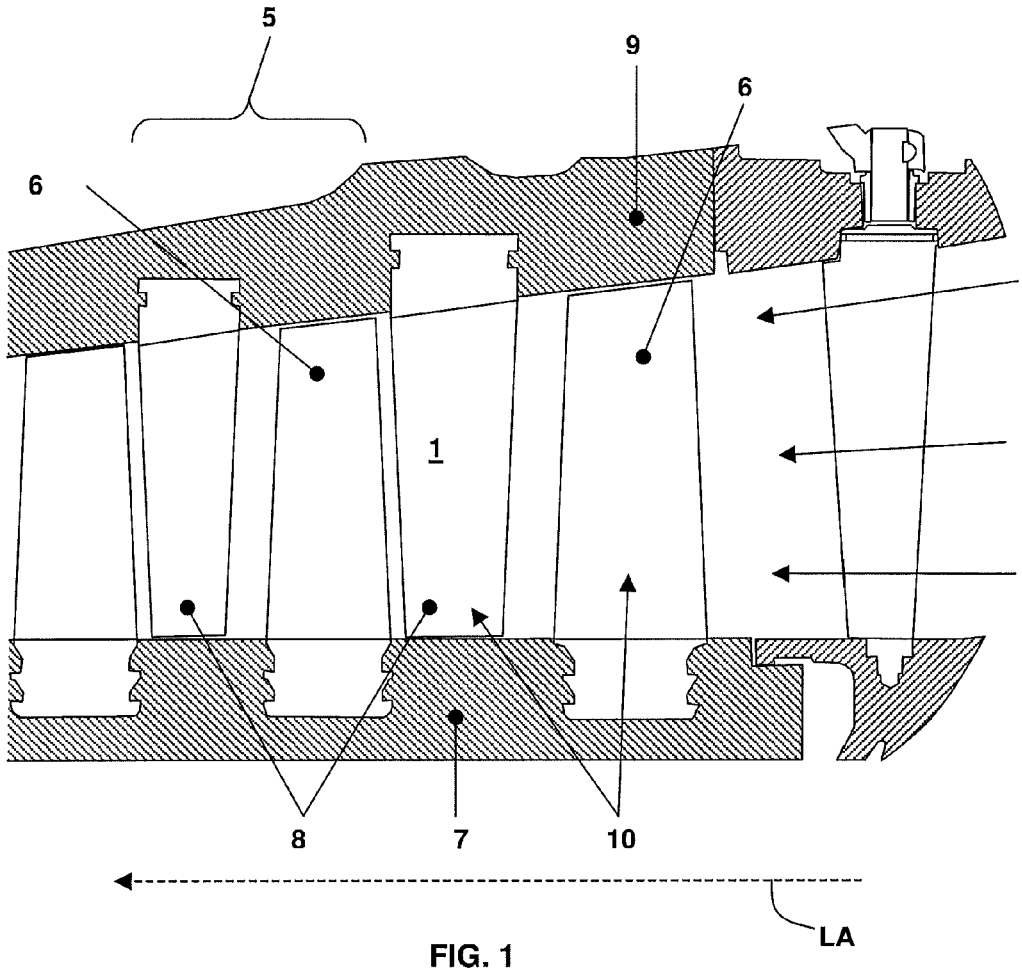
FIG. 1 is a cross sectional view along the longitudinal axis of a portion of an exemplary compressor section of a gas turbine.

Exemplary embodiments of the present disclosure provide an improved airfoil having a unique profile for improved performance of a gas turbine compressor. This is accomplished by a unique airfoil profile defined in terms of stagger angle and camber angle. Further, to reduce the weight of the airfoil, a reduced chord length is provided as compared to known airfoils.

According to an exemplary embodiment, the airfoil height can be scaled down by a factor of 1:1.2. In this way, unscaled and scaled aspects provide airfoils which are suitable for operation at nominally 50 Hz and 60 Hz, respectively.

Other objectives and advantages of the present disclosure will become apparent from the following description, taken in connection with the accompanying drawings which, by way of example, illustrate exemplary embodiments of the present disclosure.

Exemplary embodiments of the present disclosure are now described with reference to the drawings, wherein like reference numerals are used to refer to like elements throughout. In the following description, for purposes of explanation, numerous specific details are set forth in order to provide a thorough understanding of the disclosure. However, the present disclosure may be practiced without these specific details, and the present disclosure is not limited to the exemplary embodiments disclosed herein.

FIG. 1 illustrates a portion of an exemplary multi-stage compressor 1. Each stage of the compressor 1 comprises a plurality of circumferentially spaced blades 6 mounted on a rotor 7, and a plurality of circumferentially spaced vanes 8, which are downstream of an blade 6 along the longitudinal axis LA of the compressor 1 and are mounted on a stator 9. For illustration purposes only, the second stage 5 is shown in FIG. 1. Each of the different stages of the compressor 1 has a uniquely shaped vane 8 and blade 6 airfoils 10.

Figure 2:
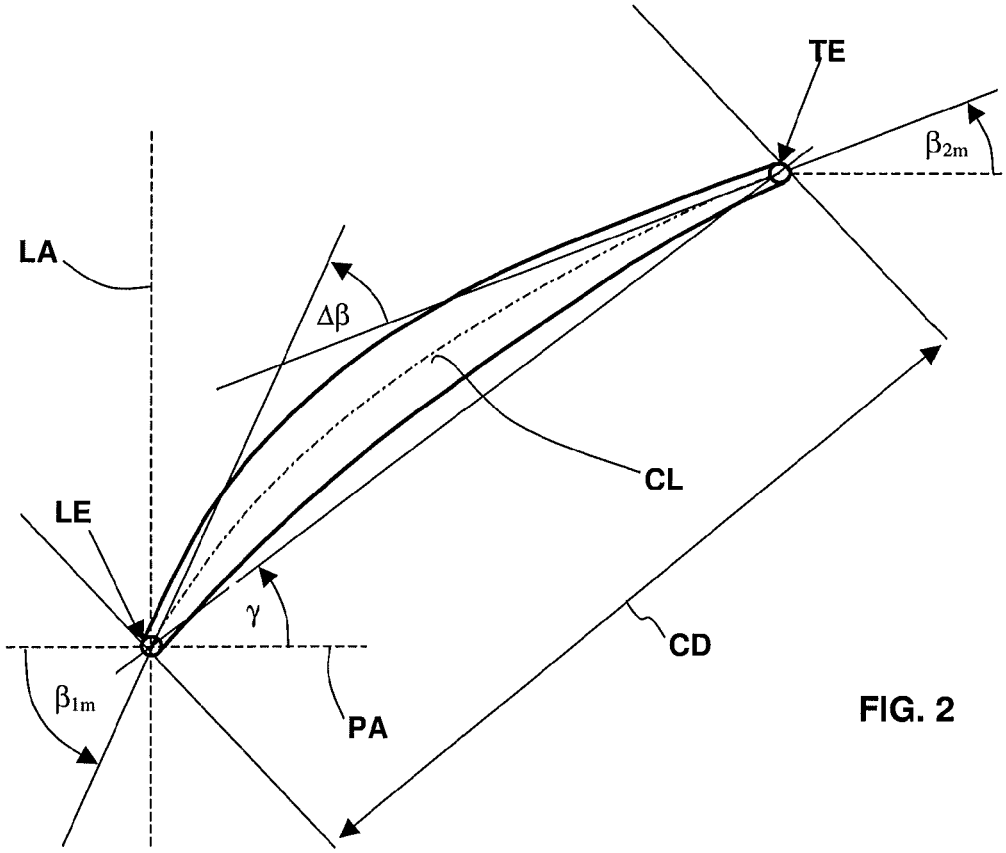
FIG. 2 is a top view of an exemplary airfoil of a blade of FIG. 1 used to define the characteristic dimensions of stagger angle, camber angle and chord length.

FIG. 2 is a top view of an airfoil 10 of a blade of FIG. 1 used to exemplarily define the airfoil 10 terms of stagger angle $\gamma$, camber angle $\Delta\beta$ and chord length CD used throughout this specification.

The stagger angle γ is defined, as shown in FIG. 2, as the angle between a line drawn between the leading edge LE and the trailing edge TE and a line PA that is perpendicular to the longitudinal axis LA.

The camber angle Δβ, as shown in FIG. 2, is defined by:

the camber line CL, which is the mean line of the blade profile extending from the leading edge LE to the trailing edge TE;

the inlet angle β1*m*, which is the angle, at the leading edge LE, between the line PA perpendicular to the longitudinal axis PA and a tangent to the camber line CL; and the outlet angle β2*m*, which is the angle, at the trailing edge TE, between the line PA perpendicular to the longitudinal axis LA and a tangent to the camber line CL. As shown in FIG. 2 the camber angle Δβ is the external angle formed by the intersection of tangents to the camber line CL at the leading edge LE and trailing edge TE and is equal to the difference between the inlet angle β1*m* and the outlet angle β2*m*.

As shown in FIG. 2, the chord length CD is defined as the distance between tangent lines drawn perpendicular to the longitudinal axis LA at the leading edge LE and at the trailing edge TE.

Figure 3:
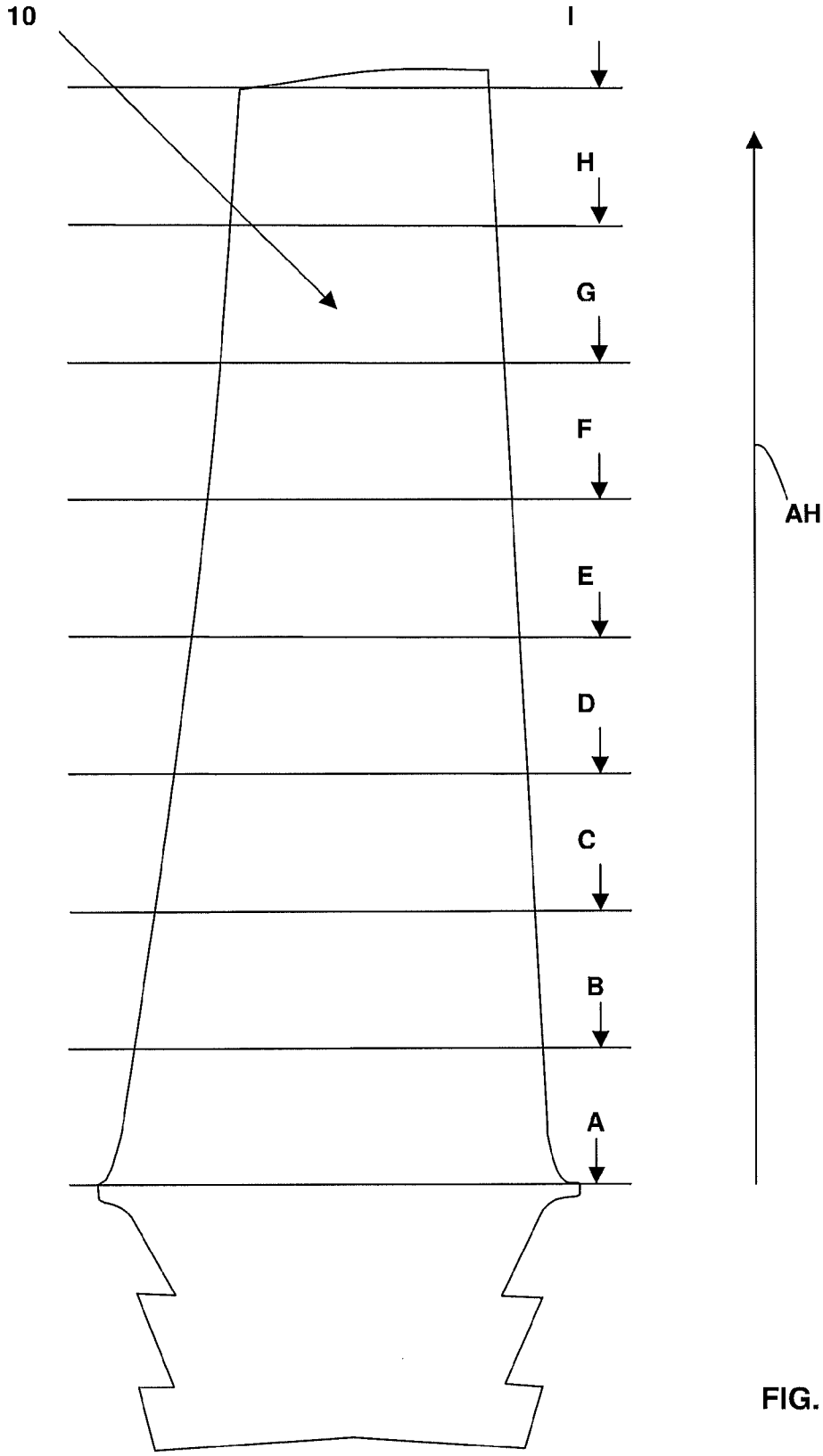
FIG. 3 is a side view of an exemplary blade of FIG. 1 showing airfoil height divisions in the radial direction.

The stagger angle γ, camber angle Δβ and chord length CD, as defined in FIG. 2, can vary along the airfoil height AH (shown in FIG. 3). In order to define an airfoil 10 references can be made to divisions of the airfoil height AH (see FIG. 3). For example, FIG. 3 shows arbitrary divisions enumerated from a reference point A at the base end of the airfoil 10 and continuing to point I at a distal end of the airfoil.

Figure 4:
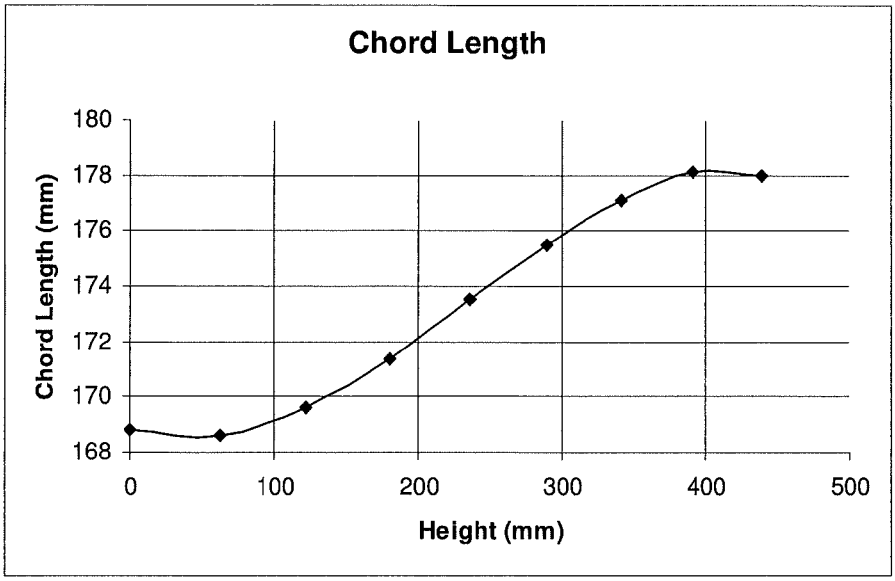
FIG. 4 is a chart showing the chord length versus airfoil height according to an exemplary embodiment of the present disclosure.
Figure 5:
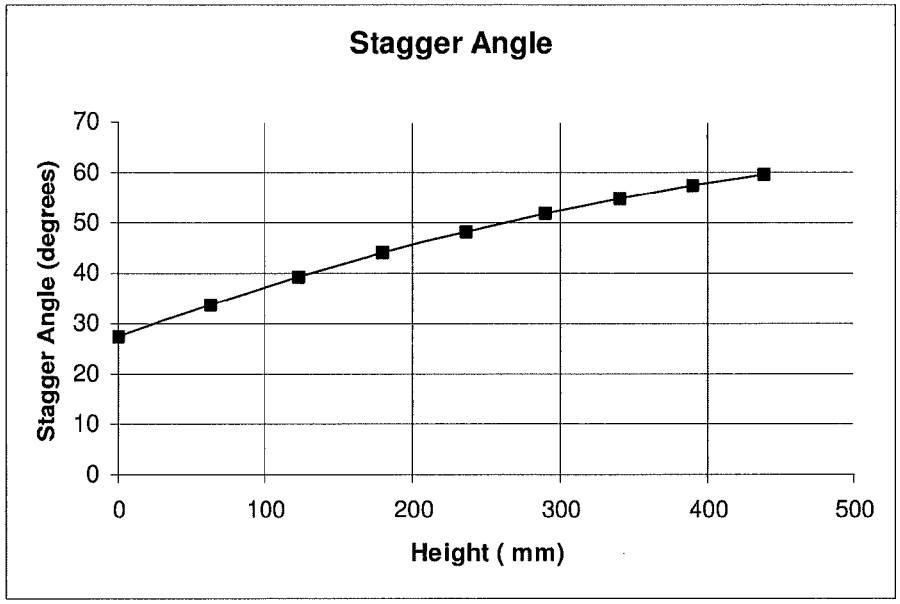
FIG. 5 is a chart showing the stagger angle versus airfoil height according to an exemplary embodiment of the present disclosure.
Figure 6:
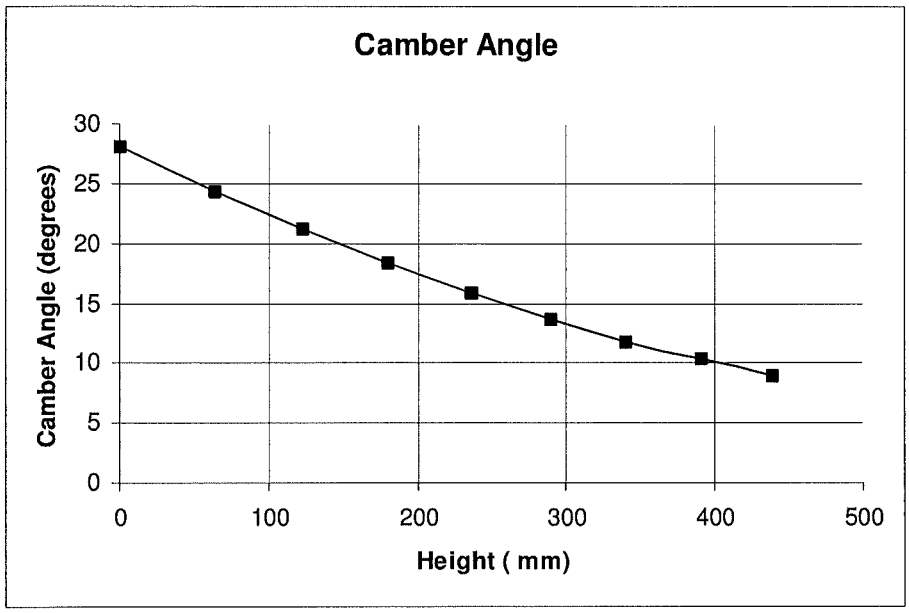
FIG. 6 is a chart showing the chord length versus airfoil height according to an exemplary embodiment of the present disclosure.

An embodiment of the disclosure will now be described, by way of example, with reference to the dimensional characteristics defined in FIG. 2 at various airfoil heights AH in the radial direction as shown in FIG. 3 measured from a base end of the airfoil 10. The exemplary embodiment, which is suitable for a gas turbine compressor operating at 50 Hz, for example, comprises an airfoil 10 for the second stage 5 blade 6 of a compressor 1, as shown in FIG. 1, having chord lengths CD as set forth in Table 1 and FIG. 4, stagger angles γ as set forth in Table 1 and FIG. 5, and camber angles Δβ as set forth in Table 1 and FIG. 6, wherein the data in Table 1 and FIGS. 4 to 6 is carried to three decimal places. In another embodiment the tolerance value for the chord lengths CD and the airfoil height AH is ±10 millimeters and the tolerance value for the stagger angles γ and camber angles Δβ is ±1°.

TABLE 1

| Divisions | Airfoil height AH (mm) | Stagger angle γ (degrees) | Chord length CD (mm) | Camber angle Δβ (degrees) |
|---|---|---|---|---|
| A | 0.000 | 27.282 | 168.800 | 28.038 |
| B | 63.053 | 33.687 | 168.600 | 24.400 |
| C | 123.015 | 39.234 | 169.600 | 21.195 |
| D | 180.479 | 44.049 | 171.400 | 18.324 |
| E | 235.744 | 48.213 | 173.500 | 15.840 |
| F | 289.030 | 51.793 | 175.500 | 13.693 |
| G | 340.550 | 54.848 | 177.100 | 11.851 |
| H | 390.500 | 57.428 | 178.100 | 10.289 |
| I | 439.080 | 59.577 | 178.000 | 8.976 |

In a further embodiment, the airfoil height AH is scaled down by a factor of 1:1.2 in order to be made suitable for operation at 60 Hz.

Although the disclosure has been herein shown and described in what is conceived to be an exemplary embodiment, it will be appreciated by those skilled in the art that the present disclosure can be embodied in other specific forms without departing from the spirit or essential characteristics thereof. The presently disclosed embodiments are therefore considered in all respects to be illustrative and not restricted. The scope of the disclosure is indicated by the appended claims rather that the foregoing description and all changes that come within the meaning and range and equivalences thereof are intended to be embraced therein.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

REFERENCE NUMBERS

| | |
|---|---|
| 1 | Compressor |
| 5 | First stage |
| 6 | Blade |
| 7 | Rotor |
| 8 | Vanes |
| 9 | Stator |
| 10 | Airfoil |
| γ | Stagger angle |
| β1m | Inlet angle |
| β2m | Outlet angle |
| Δβ | Camber angle |
| CD | Chord length |
| CL | Camber line |
| LE | Leading edge |
| TE | Trailing edge |
| LA | Longitudinal axis |
| PA | Line perpendicular to the longitudinal axis |
| AH | Airfoil height |
| A-I | Airfoil divisions |

What is claimed is:

1. An airfoil for a second stage compressor blade, the airfoil comprising a plurality of chord lengths, a plurality of stagger angles, and a plurality of camber angles at a plurality of divisions, respectively, along an airfoil height starting from a reference point at a first end of the airfoil extending to a second distal end, wherein:

at a first division starting from the reference point, the airfoil height is 0.000 mm, the stagger angle is 27.282 degrees, the chord length is 168.800 mm, and the camber angle is 28.038 degrees, at a second division between the first division and the second distal end of the airfoil, the airfoil height is 63.053, the stagger angle is 33.687 degrees, the chord length is 168.600 mm, and the camber angle is 24.400 degrees, at a third division between the second division and the second distal end of the airfoil, the airfoil height is 123.015 mm, the stagger angle is 39.234 degrees, the chord length is 169.600 mm, and the camber angle is 21.195 degrees, at a fourth division between the third division and the second distal end of the airfoil, the airfoil height is 180.479 mm, the stagger angle is 44.049 degrees, the chord length is 171.400 mm, and the camber angle is 18.324 degrees, at a fifth division between the fourth division and the second distal end of the airfoil, the airfoil height is 235.744 mm, the stagger angle is 48.213 degrees, the chord length is 173.500 mm, and the camber angle is 15.840 degrees, at a sixth division between the fifth division and the second distal end of the airfoil, the airfoil height is 289.030 mm, the stagger angle is 51.793 degrees, the chord length is 175.500 mm, and the camber angle is 13.693 degrees, at a seventh division between the sixth division and the second distal end of the airfoil, the airfoil height is 340.550 mm, the stagger angle is 54.848 degrees, the chord length is 177.100 mm, and the camber angle is 11.851 degrees, at an eighth division between the seventh division and the second distal end of the airfoil, the airfoil height is 390.500 mm, the stagger angle is 57.428 degrees, the chord length is 178.100 mm, and the camber angle is 10.289 degrees, and at a ninth division between the eighth division and the second distal end of the airfoil, the airfoil height is 439.080 mm, the stagger angle is 59.577 degrees, the chord length is 178.000 mm, and the camber angle is 8.976 degrees.

2. The airfoil of claim 1, wherein tolerance values for the chord lengths and the airfoil height are ±10 millimeters, and tolerance values for the stagger angles ($\gamma$) and camber angles ($\Delta\beta$) are ±1°.

3. The airfoil of claim 1, wherein the airfoil height is scaled down by a factor of 1:1.2.

4. The airfoil of claim 2, wherein the airfoil height is scaled down by a factor of 1:1.2.

5. The airfoil of claim 1, wherein the values of the airfoil height, stagger angle, chord length and camber angle are carried to three decimal places.

* * * * *